US008430369B2

(12) United States Patent
Hsu et al.

(10) Patent No.: US 8,430,369 B2
(45) Date of Patent: Apr. 30, 2013

(54) WALL MOUNTING BATH ACCESSORY ASSEMBLY

(75) Inventors: Weimien Hsu, Taichung (TW); Dulun Chang, Shen Zen (CN); Chunhung Li, Taichung (TW)

(73) Assignee: Globe Union Industrial Corp., Taichung (TW)

( * ) Notice: Subject to any disclaimer, the term of this patent is extended or adjusted under 35 U.S.C. 154(b) by 359 days.

(21) Appl. No.: 12/770,583

(22) Filed: Apr. 29, 2010

(65) Prior Publication Data

US 2011/0266404 A1 Nov. 3, 2011

(51) Int. Cl.
*A47B 96/00* (2006.01)

(52) U.S. Cl.
USPC ..... 248/222.14; 248/221.11; 248/220.22; 4/576.1; 211/105.1

(58) Field of Classification Search ..... None
See application file for complete search history.

(56) References Cited

U.S. PATENT DOCUMENTS

| | | | | |
|---|---|---|---|---|
| 4,907,771 | A * | 3/1990 | Wang | 248/222.14 |
| 5,402,977 | A * | 4/1995 | Korfgen et al. | 248/309.1 |
| 6,113,045 | A * | 9/2000 | Kuo | 248/222.14 |
| 6,199,808 | B1 * | 3/2001 | Lin | 248/222.14 |
| 6,520,463 | B1 * | 2/2003 | Ouano | 248/222.13 |
| 6,810,538 | B2 * | 11/2004 | Ouyoung | 4/576.1 |
| 6,817,044 | B1 * | 11/2004 | Ouyoung | 4/576.1 |
| 7,367,535 | B2 * | 5/2008 | Lai | 248/251 |
| 7,926,772 | B2 * | 4/2011 | Lowe et al. | 248/222.14 |
| 8,104,726 | B2 * | 1/2012 | Hoernig | 248/220.22 |
| 2009/0108157 | A1 * | 4/2009 | Spencer | 248/222.13 |

* cited by examiner

*Primary Examiner* — Terrell McKinnon
*Assistant Examiner* — Monica Millner

(57) ABSTRACT

A wall mounting bath accessory assembly contains a fixing member to be locked to a wall including a groove defined therein so that between the groove and the wall is defined a movable space and an upper locking portion disposed on a top end thereof; a sliding member limited to move between an upper dead center and a lower dead center of the movable space and including an upper abutting portion disposed on a top end thereof and a lower locking portion extending from a bottom end thereof; a retaining member located on an outer side of the fixing member and including an upper fastening portion extending from a top end of thereof, and a lower fastening portion extending from a bottom end thereof; a base including a receiving chamber to receive the retaining member, the fixing member, and the sliding member.

15 Claims, 12 Drawing Sheets

WALL MOUNTING BATH ACCESSORY ASSEMBLY

BACKGROUND OF THE INVENTION

1. Field of the Invention

The present invention relates to a wall mounting bath accessory assembly.

2. Description of the Prior Art

A conventional wall mounting bath accessory assembly is used in a rack to hold cloth, cap, towel and toilet papers, and includes a fixing member and a base. The fixing member is locked to a wall by using an anchor and a first bolt element, and includes a peripheral surface to be covered by a disc-shaped cover on the base, and a second bolt elements is inserted through the cover to retain the base to the fixing member, however, such the base disengages from the wall easily and is removed difficulty.

To overcome above-mentioned shortcomings, an improved wall mounting bath accessory assembly is disclosed in CN Pat. Nos. 201365798 and 2601614, and U.S. Pub. No. US 20090108157 that include a retaining member to be locked to the base in advance so that the base is fixed by using the retaining member and the fixing member without applying any bolt elements.

However, the retaining member engages with the fixing member vertically, therefore when the bath accessory assembly moves, the base is contacted to disengage from the fixing member easily. Furthermore, the base and the retaining member are removed easily that will be taken away if they are made of precious metal materials.

The present invention has arisen to mitigate and/or obviate the afore-described disadvantages.

SUMMARY OF THE INVENTION

The primary object of the present invention is to provide a wall mounting bath accessory assembly which is capable of overcoming the shortcomings of the conventional wall mounting bath accessory assembly.

Further object of the present invention is to provide a wall mounting bath accessory assembly that can fix the base, the fixing member, and the sliding member together securely.

Another object of the present invention is to provide a wall mounting bath accessory assembly that the base is removed by a certain removing process to prevent from being removed easily, obtaining burglarproof effect.

Also another object of the present invention is to provide a wall mounting bath accessory assembly that can be assembled and disassembled easily.

To obtain the above objectives, a wall mounting bath accessory assembly provided by the present invention comprises a fixing member to be locked to a wall including a groove defined therein so that between the groove of the fixing member and the wall is defined a movable space; and the fixing member including an upper locking portion disposed on a top end thereof;

a sliding member limited to move between an upper dead center and a lower dead center of the movable space; the sliding member including an upper abutting portion disposed on a top end thereof and a lower locking portion extending from a bottom end thereof;

a retaining member located on an outer side of the fixing member and including an upper fastening portion extending from a top end of thereof, and a lower fastening portion extending from a bottom end thereof; the fastening portion moving across the top end of the fixing member to engage with the upper abutting portion of the sliding member, when the retaining member is pushed downward, the sliding member is actuated to slide downward to the bottom dead center, and the upper fastening portion engages with the upper locking portion of the fixing member, the lower fastening portion is pushed inward to engage with the lower locking portion of the sliding member;

a base including a receiving chamber to receive the retaining member, the fixing member, and the sliding member.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
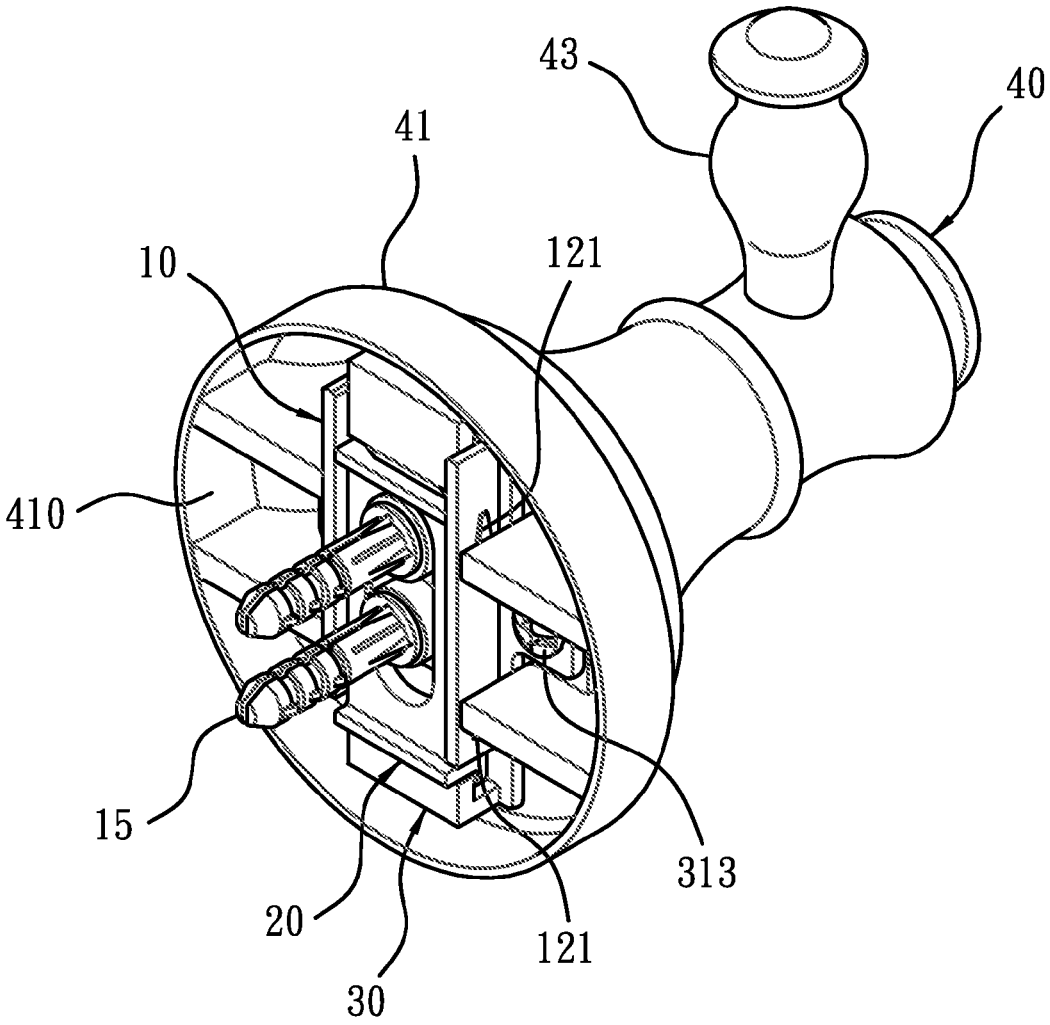
FIG. 1 is a perspective view showing the assembly of a wall mounting bath accessory assembly according to a first embodiment of the present invention.
Figure 2:
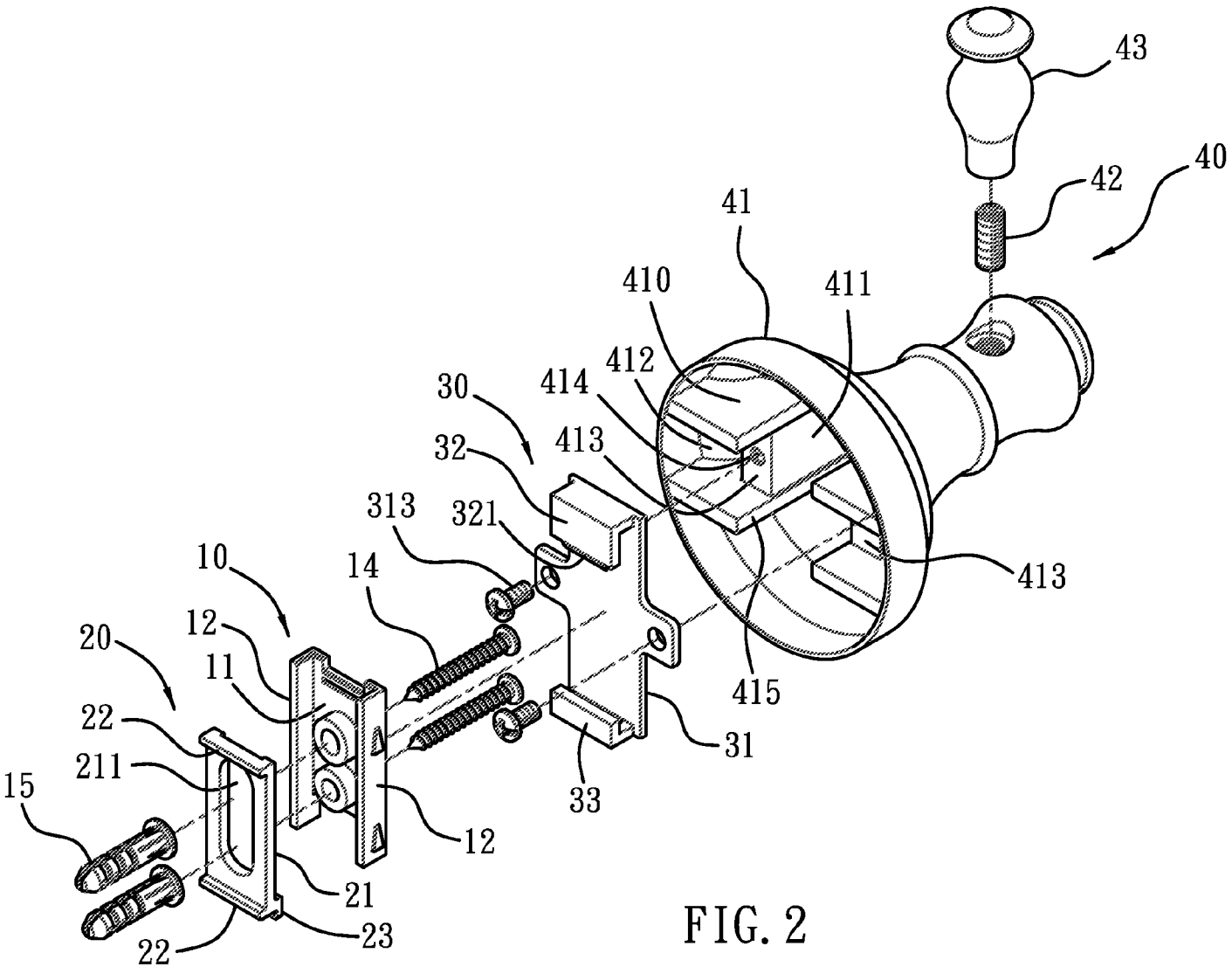
FIG. 2 is a perspective view showing the exploded components of the wall mounting bath accessory assembly according to the first embodiment of the present invention.

Referring to FIGS. 1 and 2, a wall mounting bath accessory assembly according to a first embodiment of the present invention comprises a fixing member 10, a sliding member 20, a retaining member 30, and a base 40.

Figure 3:
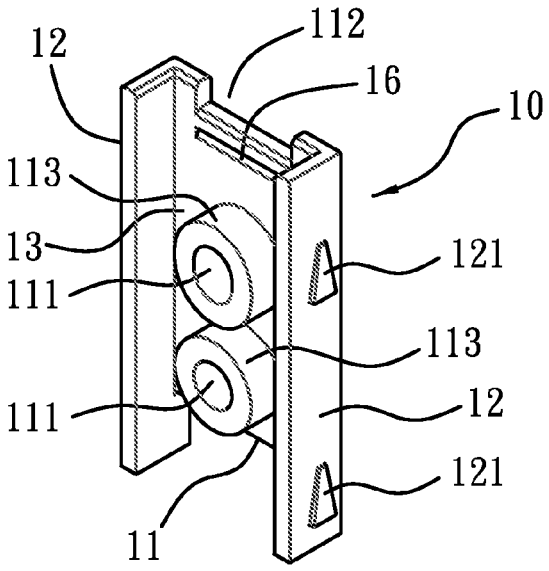
FIG. 3 is a perspective view showing the assembly of a fixing member of the wall mounting bath accessory assembly in accordance with the first embodiment of the present invention.
Figure 10:
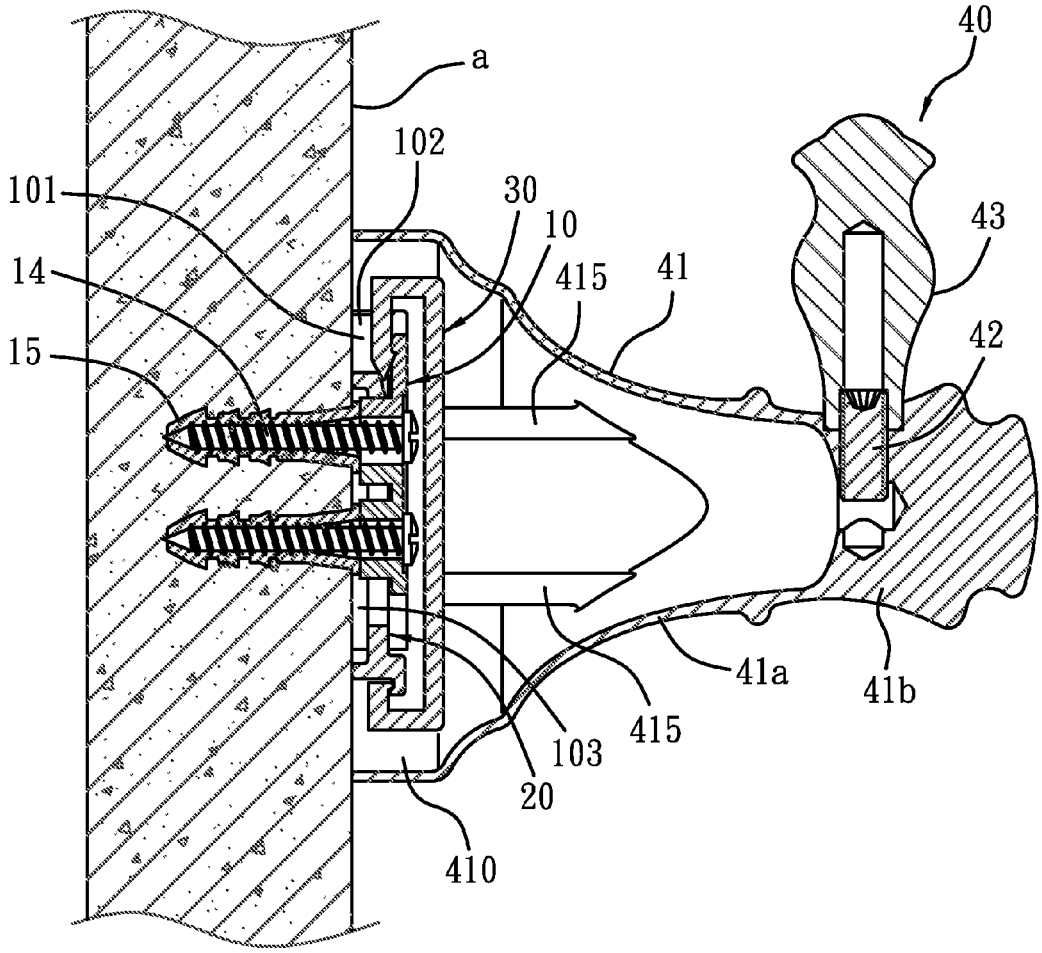
FIG. 10 is another cross sectional view showing the operation of the wall mounting bath accessory assembly in accordance with the first embodiment of the present invention.

The fixing member 10 as shown in FIG. 3, includes a positing fence 11, two side fringes 12 connecting with two sides of the positioning fence 11 respectively, and a groove 13 defined between the positioning fence 11 and the side fringes 12; the positioning fence 11 includes two holes 111 formed on predetermined positions thereof individually to insert first bolt elements 14 so that the first bolt elements 14 are screwed with anchors 15 which are fixed to a wall a, such that the fixing member 10 is locked to the wall a. When the fixing member 10 is locked to the wall a, the two side fringes 12 of the fixing member 10 contact with the wall a so that between the groove 13 of the fixing member 10 and the wall a is defined a movable space 101 as illustrated in FIG. 10, and the movable space 101 includes a top opening 102 and a bottom opening 103 arranged on an upper and a lower sides thereof respectively.

The fixing member 10 also including an upper locking portion 16 disposed on a top end thereof. In this embodiment, the upper locking portion 16 is an elongated engaging recess.

The positioning fence 11 of the fixing member 10 includes a cutout 112 mounted on a center of a top end thereof, and includes two limiting rims 113 extending around outer surfaces of the holes 111 individually, the limiting rim 113 is higher than the side fringe 12, therefore it is located at the movable space 101.

The side fringe 12 of the fixing member 10 includes two triangular engagement blocks 121 arranged on an upper and a lower sides thereof.

Figure 4:
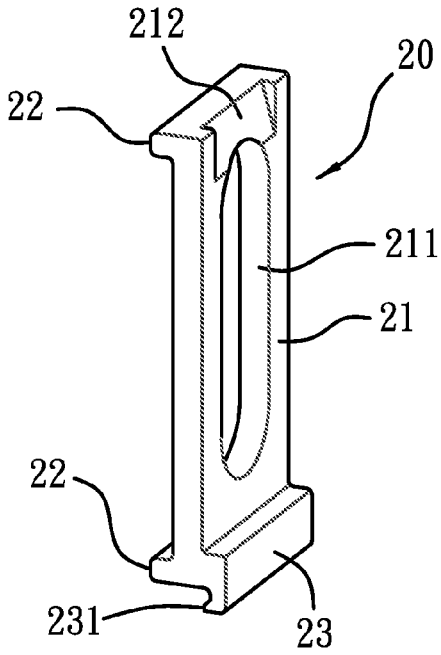
FIG. 4 is a perspective view showing the assembly of a sliding member of the wall mounting bath accessory assembly in accordance with the first embodiment of the present invention.

The sliding member 20, as illustrated in FIG. 4, includes a plate 21 and two projections 22 horizontally extending from a top and a bottom ends of the plate 21 respectively, and includes a lower locking portion 23 extending horizontally and vertically from the bottom end of the plate 21, and the lower locking portion 23 includes a first hook 231 fixed on a distal end thereof.

Figure 6:
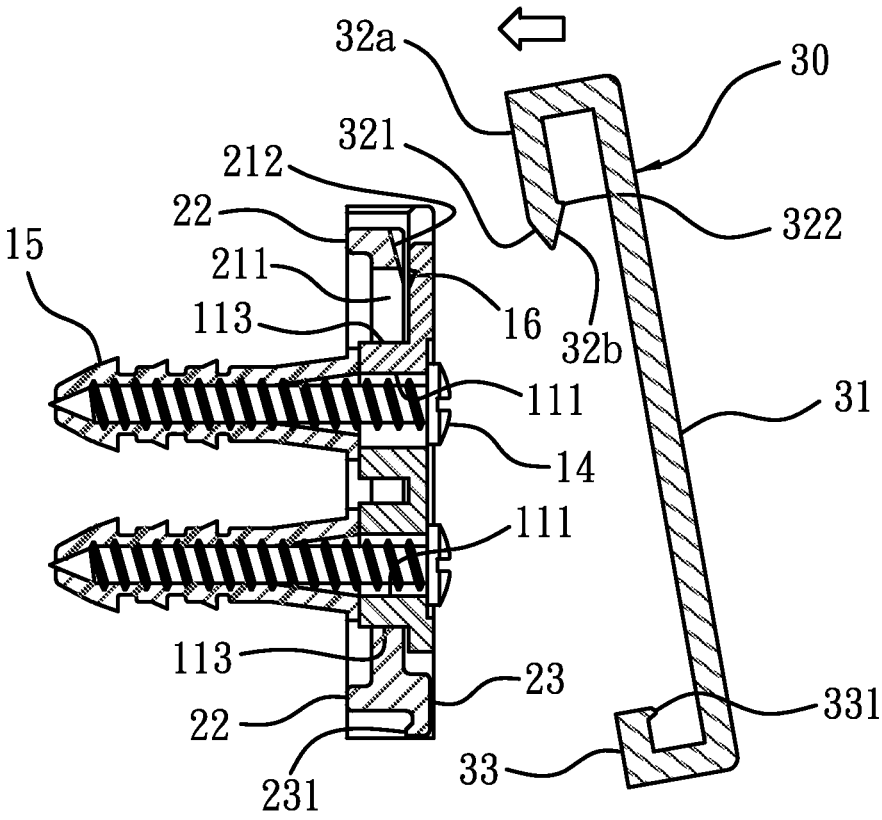
FIG. 6 is a cross sectional view showing the operation of the wall mounting bath accessory assembly in accordance with the first embodiment of the present invention.
Figure 8:
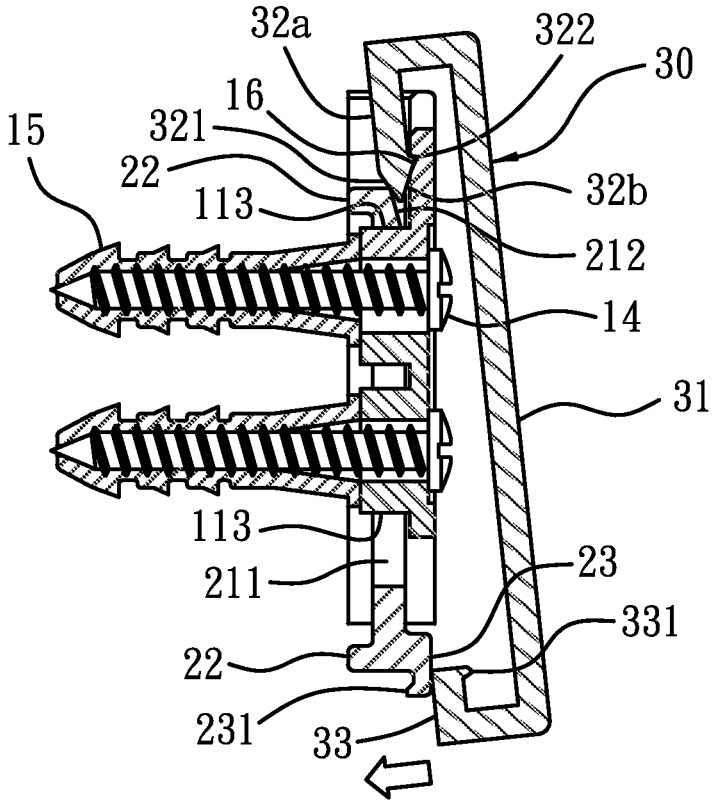
FIG. 8 is another cross sectional view showing the operation of the wall mounting bath accessory assembly in accordance with the first embodiment of the present.

The plate 21 of the sliding member 20 includes an elongated defining aperture 211 vertically formed thereon to be movably fitted to the limiting rims 113 of the fixing member 10. Because the defining aperture 211 is longer than the limiting rims 113, the sliding member 20 is limited to slide vertically along the limiting rims 113. When the sliding member 20 is pushed upward so that an inner surface of a bottom end of the defining aperture 211 is biased against an outer surface of a bottom end of the limiting rim 113 which is located at an upper side of the fixing member 10, the sliding member 20 is located at a top dead center as shown in FIG. 6. When the sliding member 20 is pushed downward so that an inner surface of a top end of the defining aperture 211 abuts against an outer surface of a top end of the limiting rim 113 which is located at an upper side of the fixing member 10, the sliding member 20 is located at a bottom dead center as illustrated in FIG. 8. It is to be noted that when the sliding member 20 is installed, the projections 22 are lower than the side fringes 12 of the fixing member 10 to engage with the wall a movably, hence the sliding member 20 can slide stably between the top and the bottom dead centers of the movable space 101.

The plate 21 of the sliding member 20 includes an upper abutting portion 212 disposed on the top end thereof. In this embodiment, the upper abutting portion 212 is an inclined surface formed on a middle section of an outer side of the top end of the plate 21, and when the sliding member 20 is located at the lower dead center, the upper abutting portion 212 is lower than the upper locking portion 16 of the fixing member 10 as illustrated in FIG. 8 so that the upper locking portion 16 exposes properly that can not be shield by the upper abutting portion 212 and the top end of the sliding member 20.

Figure 5:
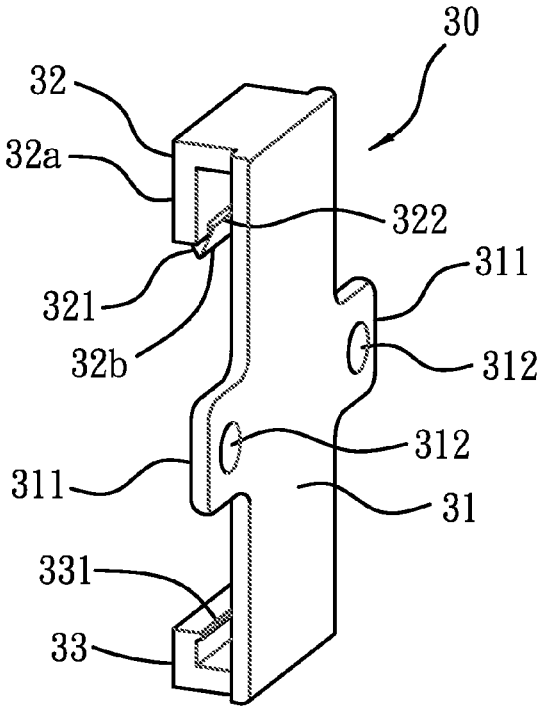
FIG. 5 is a perspective view showing the assembly of a retaining member of the wall mounting bath accessory assembly in accordance with the first embodiment of the present invention.

The retaining member 30 as shown in FIG. 5, is located on an outer side of the fixing member 10 and includes a panel 31, an upper fastening portion 32 extending outward horizontally and downward vertically from a top end of the panel 31, and a lower fastening portion 33 extending outward horizontally and upward vertically from a bottom end of the panel 31.

Figure 7:
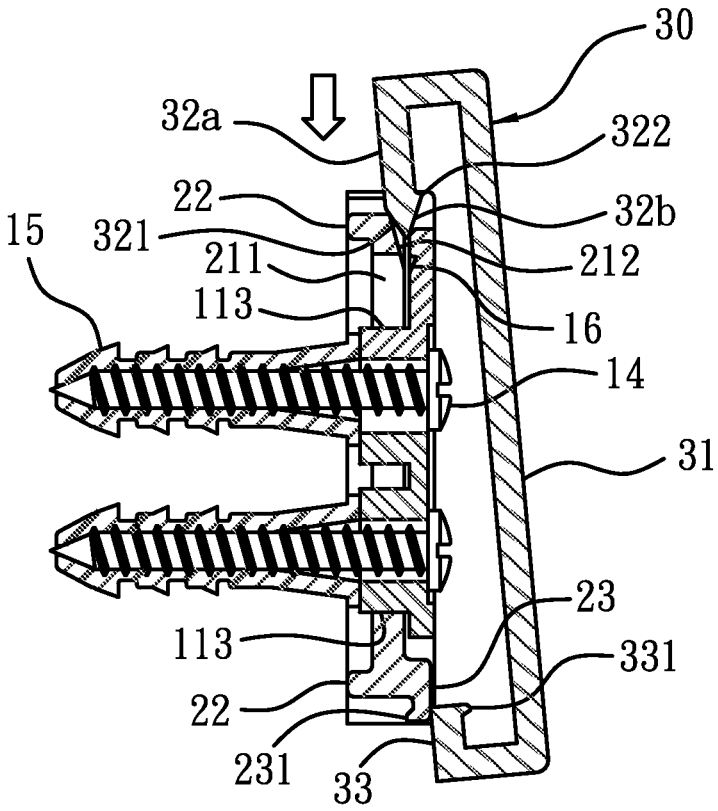
FIG. 7 is another cross sectional view showing the operation of the wall mounting bath accessory assembly in accordance with the first embodiment of the present invention.

The upper fastening portion 32 is formed in an inverted L shape and includes a L-shaped portion **32*a*, and a biasing portion 32*b* connecting with a bottom end of the L-shaped portion 32*a*, wherein a width of the L-shaped portion 32*a* is less than a distance between the side fringes 12 of the fixing member 10 so that the L-shaped portion 32*a* moves vertically in the movable space 101, and a width of the biasing portion 32*b* is less than that of the cutout 112 so that the biasing portion 32*b* moves across the cutout 112 smoothly as illustrated in FIGS. 6 and 7. In this embodiment, the biasing portion 32*b* includes a beveled plane 321 mounted on an inner side thereof to abut against the upper abutting portion 212 of the sliding member 20 so that the sliding member 20 is pushed downward, and an inner surface of the panel 31 of the retaining member 30 keeps a certain distance away from an outer surface of the positioning fence 11 of the fixing member 10, thereby a head end 141 of the first bolt element 14 is received between the inner surface of the panel 31 of the retaining member 30 and an outer surface of the positioning fence 11 of the fixing member 10. The biasing portion 32*b* includes an elongated shoulder 322 extending toward the L-shaped portion 32*a*, and when the sliding member 20 moves downward to the bottom dead center, the shoulder 322 engages with the upper locking portion 16 as illustrated in FIG. 8 so that the retaining member 30 is retained by using the upper fastening portion 32 to engage with the upper locking portion 16 of the fixing member 10**.

Figure 9:
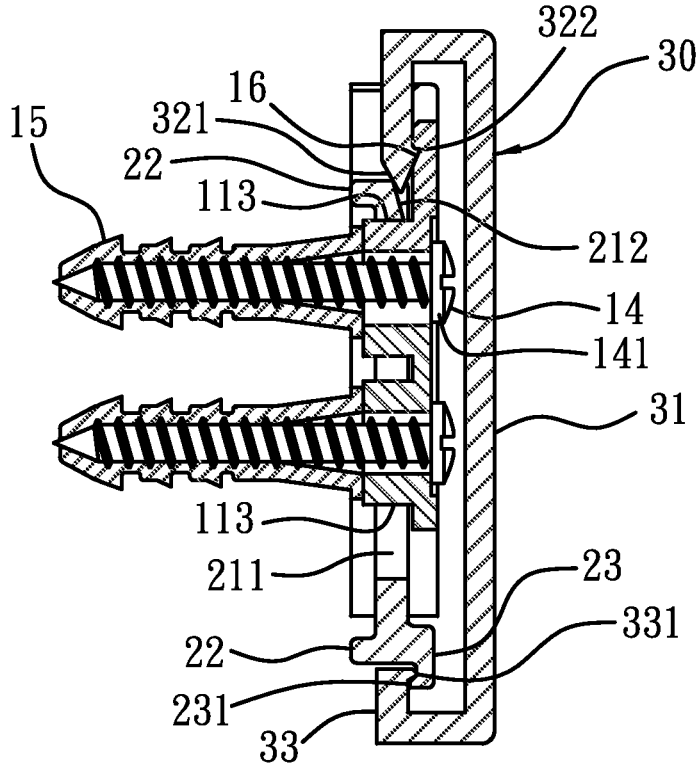
FIG. 9 is another cross sectional view showing the operation of the wall mounting bath accessory assembly in accordance with the first embodiment of the present invention.

In this embodiment, the lower fastening portion 33 is formed in a L shape and includes a second hook 331 fixed on a distal end thereof; when the retaining member 30 retains with the upper locking portion 16 of the fixing member 10 by ways of the upper fastening portion 32, the lower fastening portion 33 of the retaining member 30 is pushed inward to abut against and engage with the lower locking portion 23 of the sliding member 20 as shown in FIGS. 9 and 10, wherein when the lower fastening portion 33 engages with the lower locking portion 23, a crashing sound is made so that a user distinguishes the lower fastening portion 33 engages with the lower locking portion 23 clearly.

In this embodiment, the panel 31 includes two protrusions 311 arranged on two sides of a middle section thereof individually, and each protrusion 311 includes an orifice 312 disposed thereon to insert a second bolt element 313.

The base 40 as illustrated in FIGS. 1, 2, and 10, is connected with the retaining member 30. In this embodiment, the base 40 includes a body 41, a third bolt element 42, and a hooking shaft 43.

The body 41 includes a cover portion 41*a* and a head portion 41*b*, and the cover portion 41*a* includes a receiving chamber 410 defined therein. In this embodiment, the receiving chamber 410 includes a longitudinal receiving portion 411 to receive the panel 31, the upper fastening portion 32, and the lower fastening portion 33, and includes two lateral receiving portions 412 to communicate with the longitudinal receiving portion 411 and to receive the protrusions 311; the lateral receiving portion 412 includes a connecting fence 413 mounted therein to contact with the protrusion 311 of the retaining member 30, and the connecting fence 413 includes a bore 414 to screw with the second bolt element 313 of the retaining member 30 so as to connect the retaining member 30 into the receiving chamber 410 of the body 41, hence the base 40 is connected with the fixing member 10 and the sliding member 20 by using the retaining member 30, and the receiving chamber 410 (more particularly to the lateral receiving portion 412) is deeper enough to receive the fixing member 10 and the sliding member 20.

The longitudinal receiving portion 411 of the body 41 includes two ribs 415 formed on two sides thereof and on an upper and a lower ends of the lateral receiving portion 412 respectively so that when the base 40 pushes the sliding member 20 to move downward by using the upper fastening portion 32 of the retaining member 30, the ribs 415 contact with the engagement blocks 121 of the side fringes 12 of the fixing member 10, and when the sliding member 20 displaces to the lower dead center, the lower fastening portion 33 of the retaining member 30 engages with the lower locking portion 23 of the sliding member 20 tightly.

The hooking shaft 43 is screwed to the head portion 41*b* of the body 41 by ways of the third bolt element 43. In this embodiment, the third bolt element 43 is a countersink head.

In assembly, the sliding member 20 is movably fitted to the fixing member 10, and the anchors 15 and the first bolt elements 14 are used to lock the fixing member 10 to the wall a, and then the retaining member 30 fixed in the receiving member 410 of the body 41 of the base 40 is retained with the upper locking portion 16 of the fixing member 10 by using the upper fastening portion 32 as illustrated in FIG. 18. Thereafter, the lower fastening portion 33 is engaged with the lower locking portion 23 of the sliding member 20 which is pushed to the lower dead center as shown in FIGS. 9 and 10, finishing the assembling process.

In disassembly, the base 40 is pushed upward so that the upper fastening portion 32 of the retaining member 30 removes from the upper locking portion 16 of the fixing member 10, and the sliding member 20 is actuated to slide upward to the upper dead center. In the meantime, a top end of the base 40 is pulled outward so that the biasing portion 32*b* of the upper fastening portion 32 of the retaining member 30 disengages from the cutout 112 of the fixing member 10, and the base 40 is further moved downward and inward, hence the lower fastening portion 33 of the retaining member 30 disengages from the lower locking portion 23 of the sliding member 20, finishing the disassembling process.

Figure 11:
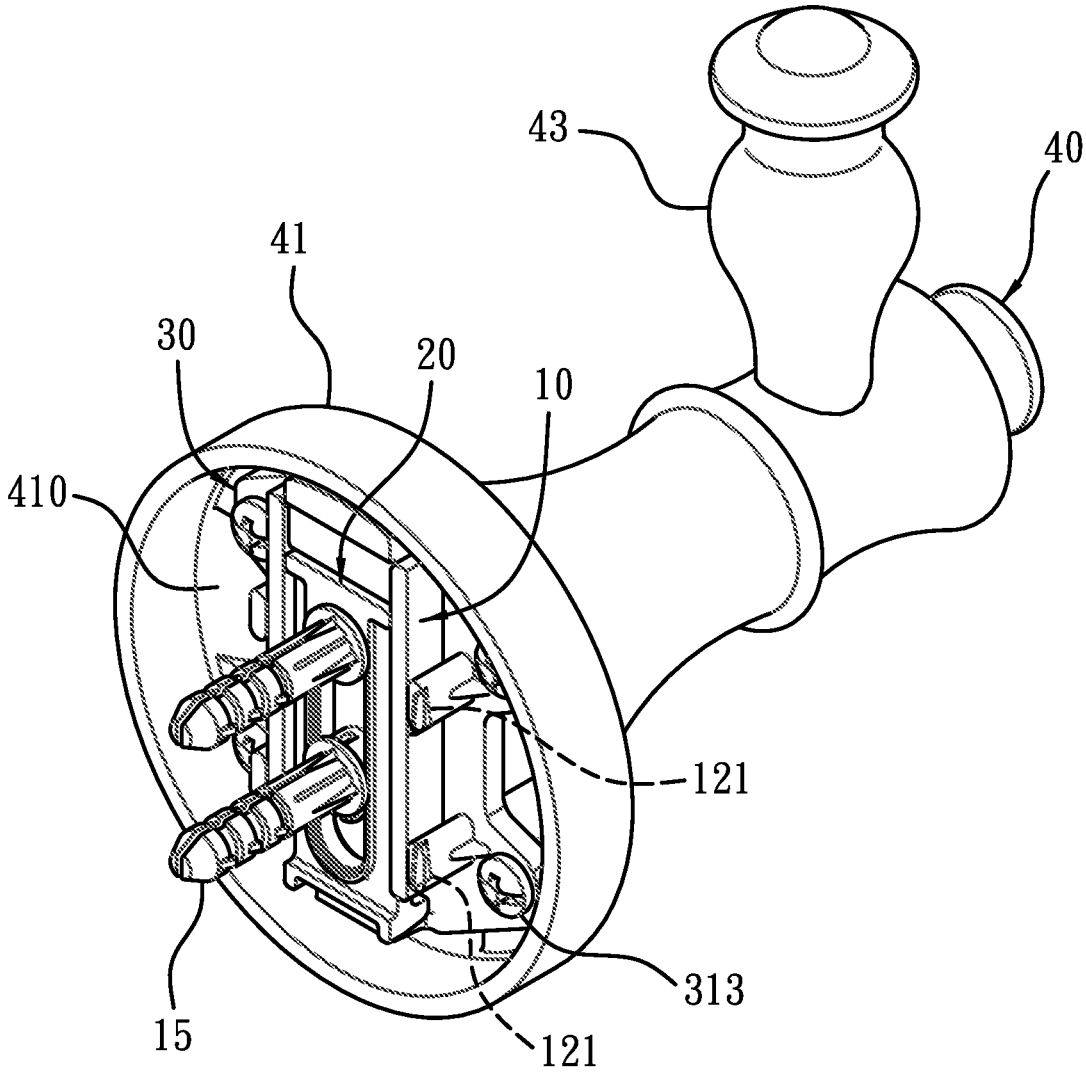
FIG. 11 is a perspective view showing the assembly of a wall mounting bath accessory assembly according to a second embodiment of the present invention.
Figure 12:
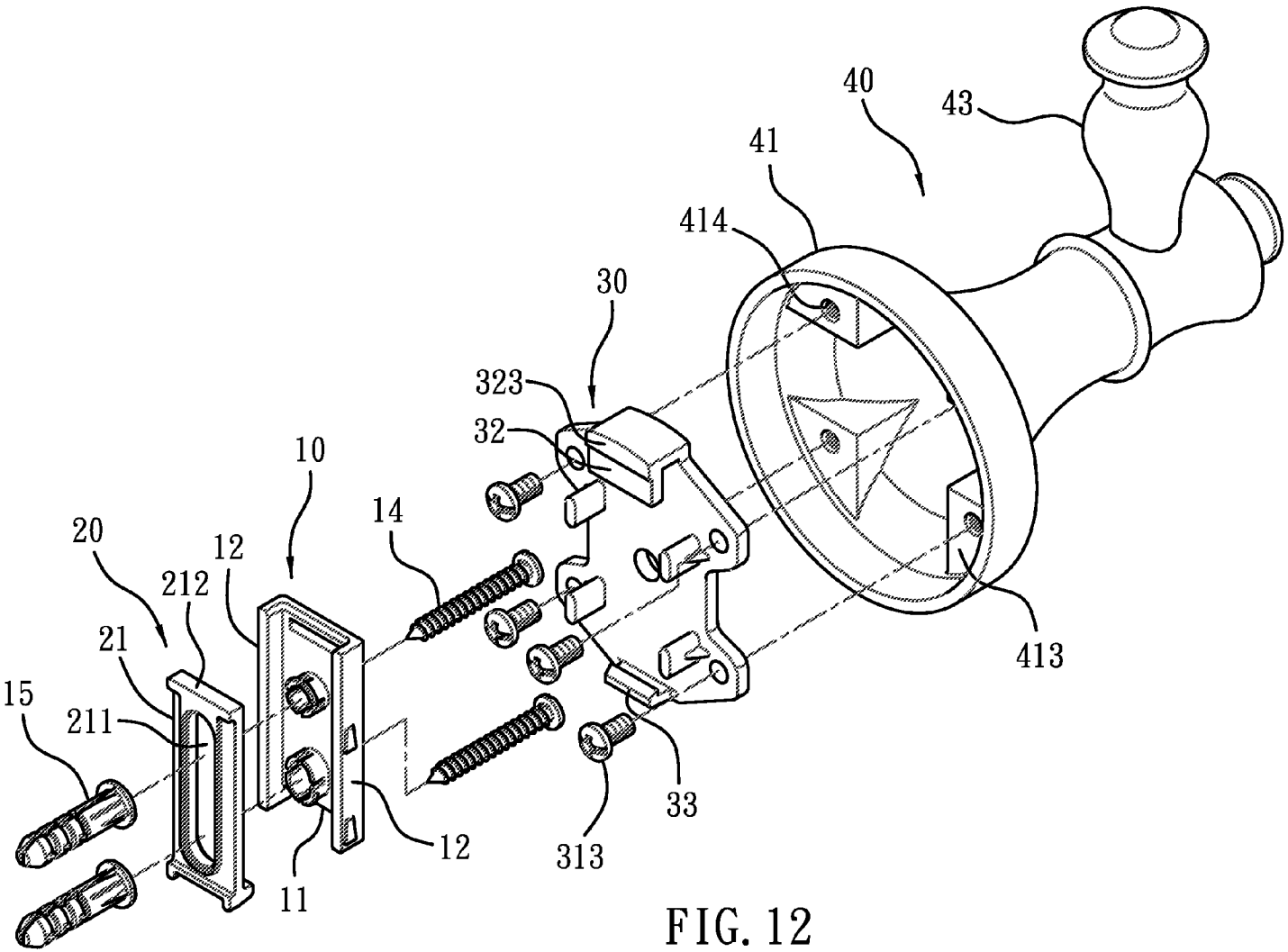
FIG. 12 is a perspective view showing the exploded components of the wall mounting bath accessory assembly according to the second embodiment of the present invention.
Figure 13:
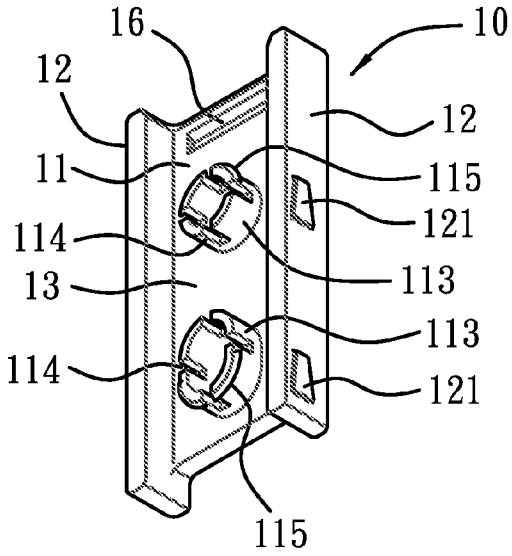
FIG. 13 is a perspective view showing the assembly of a fixing member of the wall mounting bath accessory assembly in accordance with the second embodiment of the present invention.

With reference to FIGS. 11 and 12, a wall mounting bath accessory assembly according to a second embodiment of the present invention is different from that of the first embodiment of as follows:

the fixing member 10 does not include the cutout 112 of the first embodiment as shown in FIG. 13, accordingly the upper locking portion 16 is close to the top end of the fixing member 10.

Figure 16:
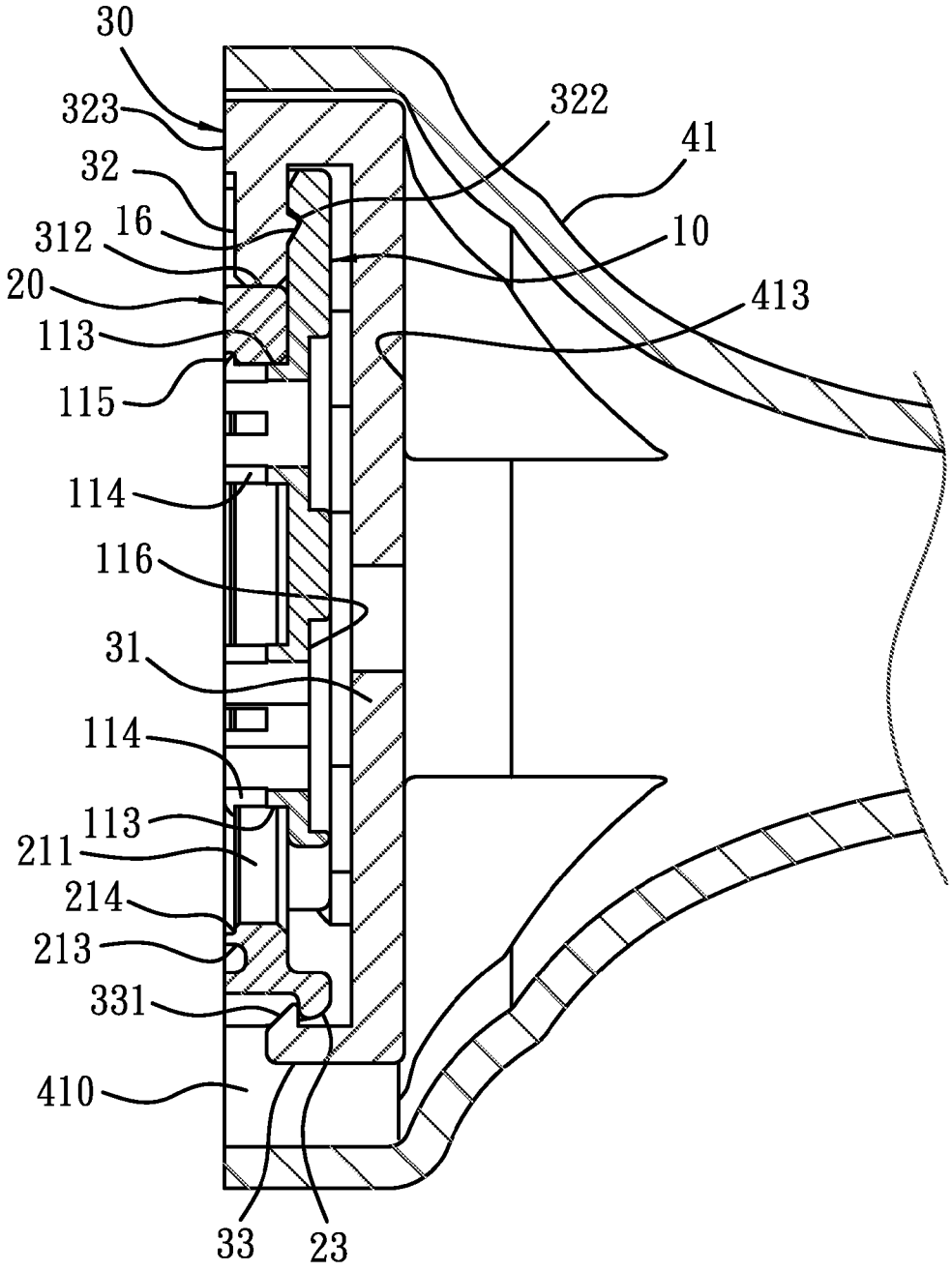
FIG. 16 is a cross sectional view showing the operation of the wall mounting bath accessory assembly in accordance with the second embodiment of the present invention.

The limiting rim 113 of the fixing member 10 includes four slots 114 disposed thereon to resiliently retract and expand, and between the limiting rim 113 on an upper side of the fixing member 10 and top edges of two slots 114 on a left and a right sides of the limiting rim 113 of the fixing member 10 is defined a third hook 115 as illustrated in FIG. 16, and between the limiting rim 113 on a lower side of the fixing member 10 and the top edges of the two slots 114 on the left and the right sides of the limiting rim 113 of the fixing member 10 is defined another third hook 115.

Figure 14:
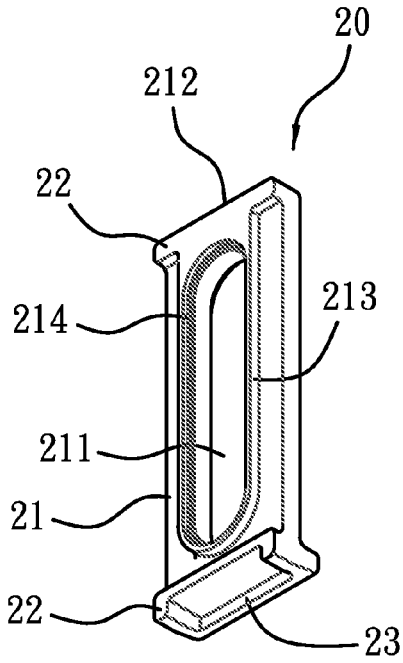
FIG. 14 is a perspective view showing the assembly of a sliding member of the wall mounting bath accessory assembly in accordance with the second embodiment of the present invention.

A top end of the sliding member 20 is formed a flat surface, as shown in FIG. 14, to be the upper abutting portion 212.

The aperture 211 of the plate 21 of the sliding member 20 includes a raised periphery 213 connected with the projection 22 on the top end of the sliding member 20, and the raised periphery 213 includes a stepped border 214 arranged around an inner surface thereof such that the defining aperture 211 of the sliding member 20 is fitted to the limiting rim 113 by means of the limiting rims 113 of the fixing member 10, and the stepped border 214 engages with the third hooks 115 of the limiting rims 113 so that the sliding member 20 engages with the fixing member 10 securely.

A lower locking portion 23 of the sliding member 20 of the second embodiment does not include the first hook 231 of the lower locking portion 23 of the sliding member 20 of the first embodiment so that the lower fastening portion 33 of the retaining member 30 is engages and disengaged easily, and the lower locking portion 23 is structurally strong.

Due to the fixing member 10 does not include a cutout 112, the upper fastening portion 32 of the retaining member 30 is provided with the biasing portion 32*b* of the first embodiment, and the shoulder 322 is directly formed on an outer side of the L-shaped portion 32*a*. Likewise, because the upper abutting portion 212 on the top end of the sliding member 20 is formed the flat surface, a bottom end of the upper fastening portion 32 of the retaining member 30 is changed to a flatly extending plane without the beveled plane 321 of the first embodiment.

Figure 15:
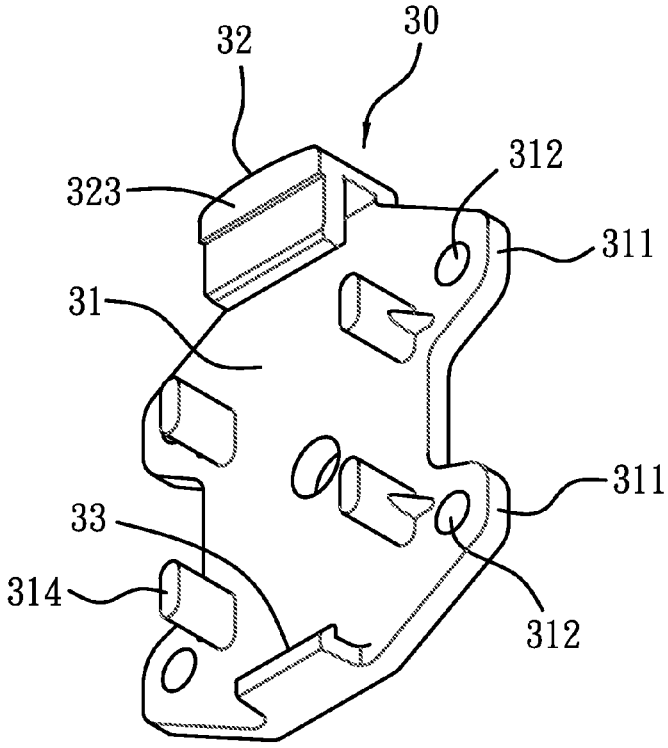
FIG. 15 is a perspective view showing the assembly of a retaining member of the wall mounting bath accessory assembly in accordance with the second embodiment of the present invention.

The panel 31 of the retaining member 30 includes four protrusions 311 as illustrated in FIG. 15 and located at four corners thereof individually, and the receiving chamber 410 includes four connecting fences 413 to retain with the protrusions 311 of the retaining member 30.

Since the upper fastening portion 32 on a top end of the retaining member 30 and the top end of the sliding member 20 are changed to a flat surface without a beveled plane 321 of the first embodiment, the upper fastening portion 32 of the retaining member 30 includes a tab 323 mounted on a top end of an inner side thereof to be retained to the wall a so that between the inner surface of the panel 31 of the retaining member 30 and the outer surface of the positioning fence 11 of the fixing member 10 is defined a predetermined room to receive the head end 141 of the first bolt element 14. In addition, the holes 111 of the positioning fence 11 of the fixing member 10 of the first and the second embodiments include recessed planes 116 as illustrated in FIGS. 9 and 16 respectively to receive the head ends 141 of the first bolt elements 14.

In assembly, the panel 31 of the retaining member 30 includes four extending pegs 314 arranged on an inner surface thereof to retain with the engagement blocks 121 of the fixing member 10 so that the fixing member 10 and the base 40 are engaged with each other securely.

While we have shown and described various embodiments in accordance with the present invention, it is clear to those skilled in the art that further embodiments may be made without departing from the scope of the present invention.

What is claimed is:

1. A wall mounting bath accessory assembly comprising:

a fixing member to be locked to a wall including a groove defined therein so that between the groove of the fixing member and the wall is defined a movable space; and the fixing member including an upper locking portion disposed on a top end thereof;

a sliding member limited to move between an upper dead center and a lower dead center of the movable space; the sliding member including an upper abutting portion disposed on a top end thereof and a lower locking portion extending from a bottom end thereof;

a retaining member located on an outer side of the fixing member and including an upper fastening portion extending from a top end of thereof, and a lower fastening portion extending from a bottom end thereof;

the upper fastening portion of the retaining member moving across the top end of the fixing member to engage with the upper abutting portion of the sliding member, when the retaining member is pushed downward, the sliding member is actuated to slide downward to the bottom dead center, and the upper fastening portion of the retaining member engages with the upper locking portion of the fixing member, the lower fastening portion of the retaining member is pushed inward to engage with the lower locking portion of the sliding member;

a base including a receiving chamber to receive the retaining member, the fixing member, and the sliding member;

wherein the sliding member is located at the lower dead center, the upper abutting portion is lower than the upper locking portion of the fixing member so that the upper locking portion exposes properly to retain with the upper fastening portion of the retaining member;

wherein the fixing member includes a positing fence, two side fringes connecting with two sides of the positioning fence respectively, and a groove defined between the positioning fence and the side fringes; the movable space includes a top opening and a bottom opening arranged on an upper and a lower sides thereof respectively, the positioning fence includes two holes formed on predetermined positions thereof individually to insert first bolt elements so that the first bolt elements are screwed with anchors which are fixed to a wall, such that the fixing member is locked to the wall;

wherein the positioning fence of the fixing member includes two limiting rims extending around outer surfaces of the holes individually; the sliding member includes an elongated defining aperture vertically formed thereon to be movably fitted to the limiting rims of the fixing member, and an inner surface of the defining aperture is biased against outer surfaces of a top and a bottom ends of the limiting rims to form the top and the bottom dead centers.

2. The wall mounting bath accessory assembly as claimed in claim 1, wherein the sliding member includes a plate to arrange the elongated defining aperture and includes two projections horizontally extending from a top and a bottom ends of the plate respectively, the projections are lower than the side fringes of the fixing member to engage with the wall.

3. The wall mounting bath accessory assembly as claimed in claim 1, wherein the sliding member includes an inclined surface formed on an outer side of the top end thereof to define the upper abutting portion; the upper fastening portion of the retaining member includes a beveled plane mounted on an inner side of a bottom end thereof to abut against the inclined surface of the sliding member so that the sliding member is pushed downward, and an inner surface of the retaining member keeps a certain distance away from an outer surface of the fixing member.

4. The wall mounting bath accessory assembly as claimed in claim 1, wherein the positioning fence of the fixing member includes a cutout mounted on a center of a top end thereof; and the retaining member includes a panel; the upper fastening portion is formed in an inverted L shape and includes a L-shaped portion, and a biasing portion connecting with a bottom end of the L-shaped portion, a width of the L-shaped portion is less than a distance between the side fringes of the fixing member so that the L-shaped portion moves vertically in the movable space, and a width of the biasing portion is less than that of the cutout so that the biasing portion moves across the cutout; the sliding member includes a plate, and the lower locking portions extend outward from a bottom ends of the plate to further extend downward, and the lower locking portion includes a first hook fixed on a distal end thereof.

5. The wall mounting bath accessory assembly as claimed in claim 4, wherein the biasing portion includes an elongated shoulder extending toward the L-shaped portion; the positioning fence of the fixing member includes an elongated recess formed on an inner surface of the cutout thereof to define the upper locking portion to retain with the shoulder.

6. The wall mounting bath accessory assembly as claimed in claim 1, wherein the retaining member a panel, the upper fastening portion extending from a top end of the panel, and the lower fastening portion extending from a bottom end of the panel; the panel includes two protrusions arranged on two sides of a middle section thereof individually, and each protrusion includes an orifice disposed thereon to insert a second bolt element.

7. The wall mounting bath accessory assembly as claimed in claim 6, wherein the base includes a body, a third bolt element, and a hooking shaft; the body includes a cover portion and a head portion, and the cover portion includes the receiving chamber and a connecting fence defined therein; the hooking shaft is screwed to the head portion of the body by ways of the third bolt element.

8. The wall mounting bath accessory assembly as claimed in claim 7, wherein the receiving chamber includes a longitudinal receiving portion to receive the panel, the upper fastening portion, and the lower fastening portion, and includes two lateral receiving portions to communicate with the longitudinal receiving portion and to receive the protrusions; the lateral receiving portion includes the connecting fence mounted therein to contact with the protrusion of the retaining member.

9. The wall mounting bath accessory assembly as claimed in claim 8, wherein the side fringe of the fixing member includes two triangular engagement blocks arranged on an upper and a lower sides thereof; the longitudinal receiving portion of the body includes two ribs formed on two sides thereof and on an upper and a lower ends of the lateral receiving portion respectively so that when the sliding member moves downward to the lower dead center, the ribs contact with the engagement blocks of the side fringes of the fixing member.

10. The wall mounting bath accessory assembly as claimed in claim 1, wherein the limiting rim of the fixing member includes four slots disposed thereon to resiliently retract and expand, and between the limiting rim on an upper side of the fixing member and top edges of two slots on a left and a right sides of the limiting rim of the fixing member is defined a third hook, and between the limiting rim on a lower side of the fixing member and the top edges of the two slots on the left and the right sides of the limiting rim of the fixing member is defined another third hook; the aperture of the plate of the sliding member includes a raised periphery, and the raised periphery includes a stepped border arranged around an inner surface thereof such that the third hooks are retained with each other.

11. The wall mounting bath accessory assembly as claimed in claim 1, wherein the retaining member includes a panel; the upper fastening portion extending from a top end of the panel and is formed in an inverted L shape, a width of the L-shaped portion is less than a distance between the side fringes of the fixing member so that the L-shaped portion moves vertically in the movable space; and the lower fastening portion extending from a bottom end of the panel, formed in a L shape, and including a second hook fixed on a distal end thereof; the sliding member includes a plate, the lower locking portion extends horizontally and vertically from the bottom end of the plate to engage with the lower fastening portion of the retaining member.

12. The wall mounting bath accessory assembly as claimed in claim 1, wherein the sliding member include a flat surface extending on the top end thereof to define the upper abutting portion; the upper fastening portion of the retaining member includes another flat surface extending on a bottom end thereof to push the sliding member downward.

13. The wall mounting bath accessory assembly as claimed in claim 12, wherein the upper fastening portion of the retaining member includes a tab mounted on a top end of an inner side thereof to be retained to the wall so that between the inner surface of a panel of the retaining member and the outer surface of the positioning fence of the fixing member is defined a predetermined room.

14. The wall mounting bath accessory assembly as claimed in claim 1, wherein the retaining member a panel, an upper fastening portion extending from a top end of the panel, and a lower fastening portion extending from a bottom end of the panel; the panel of the retaining member includes four protrusions and located at four corners thereof individually, and each protrusion includes an orifice disposed thereon to insert a second bolt element.

15. The wall mounting bath accessory assembly as claimed in claim 1, wherein the side fringe of the fixing member includes two triangular engagement blocks arranged on an upper and a lower sides thereof; the retaining member a panel, an upper fastening portion extending from a top end of the panel, and a lower fastening portion extending from a bottom end of the panel; the panel of the retaining member includes four extending pegs arranged on an inner surface thereof to retain with the engagement blocks of the fixing member when the sliding member moves downward to the lower dead center.

* * * * *